US005924367A

United States Patent [19]

Henke et al.

[11] Patent Number: 5,924,367

[45] Date of Patent: Jul. 20, 1999

[54] SHELF SIGN SYSTEM

[75] Inventors: David J. Henke, Hawthorn Woods; Kent Bach, Bensenville, both of Ill.; Max Edward Syvuk, Middleburg Heights, Ohio

[73] Assignee: RTC Industries, Inc., Rolling Meadows, Ill.

[21] Appl. No.: 08/835,667

[22] Filed: Apr. 10, 1997

[51] Int. Cl.[6] ..... A47B 9/00

[52] U.S. Cl. ..... 108/108; 40/661.03; 40/492; 40/651

[58] Field of Search ..... 108/108, 107, 108/106; 40/651, 661.03, 642.02, 492, 605

[56] References Cited

U.S. PATENT DOCUMENTS

| | | | |
|---|---|---|---|
| 3,993,002 | 11/1976 | Stroh | 108/108 |
| 4,762,235 | 8/1988 | Howard et al. | 40/651 X |
| 5,022,539 | 6/1991 | Rushing et al. | 108/108 X |
| 5,038,689 | 8/1991 | Duffy | 108/108 |
| 5,272,991 | 12/1993 | Carrigan, Jr. | 108/108 |
| 5,437,116 | 8/1995 | Hardy . | |
| 5,454,638 | 10/1995 | Bird et al. | 108/108 X |
| 5,526,944 | 6/1996 | Merl | 108/108 X |
| 5,611,442 | 3/1997 | Howard | 108/108 X |
| 5,758,585 | 6/1998 | Latchinian | 108/108 X |

*Primary Examiner*—José V. Chen
*Attorney, Agent, or Firm*—Banner & Witcoff, Ltd.

[57] ABSTRACT

A shelf sign system comprising a first shelf and a second shelf, a first mounting bracket attached to the first shelf and attached to the second shelf, the first mounting bracket spanning the first shelf and the second shelf, and a rotatable sign unit engaged with the mounting bracket. The sign unit is slidably engaged with the first mounting bracket permitting lateral movement of the sign unit. The mounting bracket may include a first flange with a first flange opening and a second flange with a second flange opening and a pin rotatably disposed in the first flange opening and the second flange opening, wherein the sign unit is engaged with the pin. The sign unit may include an L-shaped pivot bracket slidably engaging the pin. The sign unit may be rotatable from a first closed to a second open position. Also, a pivot bracket may be vertically slidable along the pin when the sign unit is in the open position so that the sign unit rests against the first and second flange.

20 Claims, 11 Drawing Sheets

SHELF SIGN SYSTEM

FIELD OF INVENTION

The present invention relates generally to a sign display system and more specifically to a sign system for use on gondola shelving units.

BACKGROUND OF THE INVENTION

Retail store locations, such as drug stores and toy stores, require a large amount of shelving to display items to consumers. The shelving should be inexpensive, easy to install and capable of housing and displaying a large number of items. To satisfy these requirements, many retail store locations use gondola shelving systems. Gondola shelving systems typically employ long metal gondola shelves attached to slotted gondola uprights. These systems can be quickly and inexpensively assembled and are universally used in retail store locations.

It is also desirable in retail store locations to employ signs along rows of shelves. These signs may include advertisements, promotional information, or product information, and may be lighted to attract consumer attention. Sometimes it is preferable for the signs to be hinged to allow easy access by store clerks or consumers to products stored behind the signs. Alternatively, it may be preferable to permanently affix the signs to the shelf system either because no product storage is desired or to prevent easy access to lighting systems situated behind the signs.

Due to inconsistencies in the gondola fixtures and installation and variances in site construction, gondola shelves are frequently not precisely aligned with one another. In other words, low quality equipment and improper installation may result in misaligned shelves. Variances in the floor level at the retail store location may also result in misaligned shelves. Thus, two gondola shelves that are supposed to be at the same height may actually be at different heights.

Even a slight misalignment of two shelves may results in visually perceptible variances in the height of signs hanging from the shelves. In a row of shelves tens or hundreds of feet long, such variation cause the signs to appear misaligned, off center, or tilted. This result is visually undesirable for a retail store location and may cause structural interference preventing optimum functionality.

Thus, an object of the present invention is a novel sign system for use on gondola shelves. A further object of the present invention is a sign system that draws gondola shelves at different heights to a common plane for hanging signs at a uniform level. Another object of the present invention is a signage in a gondola shelving system that is visually appealing to consumers.

Yet a further object of the present invention is a sign system wherein the signs may be adjusted in a variety of directions to account for variations in how the shelving is aligned. An additional object of the present invention is a hinged shelf system wherein a sign is rotatable from an open to a closed position.

Yet a further object of the present invention is a rotatable sign that can be locked in an open position. An additional object of the present invention is a sign shelf system wherein the sign can be locked in a closed position with slidable fasteners that account for shelving dimension variations. An further object of the invention is an illuminated sign on a gondola shelf system.

SUMMARY OF THE INVENTION

In principal aspect, the present invention is a shelf sign system comprising at least a first shelf and a second shelf, a first mounting bracket attached to the first shelf and attached to the second shelf, wherein the first mounting bracket spans the first shelf and the second shelf. A rotatable sign unit is engaged with the mounting bracket.

The sign unit may be slidably engaged with the first mounting bracket, permitting lateral movement of the sign unit. In addition, the mounting bracket may include a first flange with a first flange opening and a second flange with a second flange opening and a pin rotatably disposed in the first flange opening and the second flange opening, wherein the sign unit is engaged with the pin. The sign unit may include an L-shaped pivot bracket slidably engaging the pin.

The invention may also include a first affixing device attaching the mounting bracket to the first shelf, wherein the first affixing device is engaged in a first shelf opening and a first mounting bracket opening, and a second affixing device attaching the mounting bracket to the second shelf, wherein the second affixing device engaged in a second shelf opening and a second mounting bracket opening. The affixing device may be a screw and nut pair.

Further, the sign unit may be rotatable from a first closed to a second open position. In addition, the pivot bracket may be vertically slidable along the pin when the sign unit is in the open position so that the sign unit rests against the first and second flange.

BRIEF DESCRIPTION OF THE DRAWINGS

Preferred embodiments of the present invention are described with reference to the following drawings where.

DETAILED DESCRIPTION OF THE PREFERRED EMBODIMENT

Figure 1:
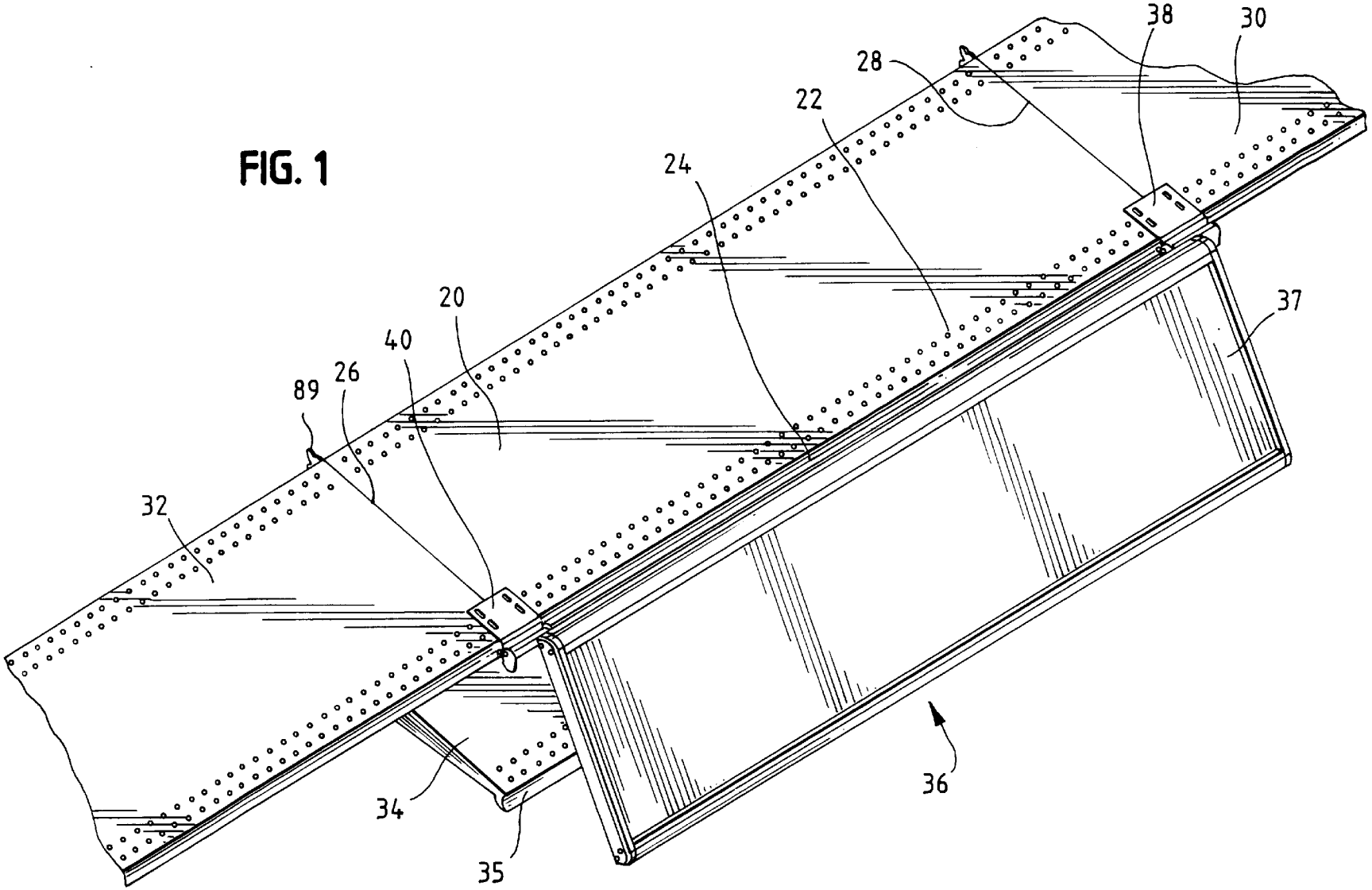
FIG. 1 is an overhead oblique view of the shelf sign system invention.

Referring to FIG. 1, which is an overhead view of a preferred embodiment of the invention, a gondola shelf 20 with a plurality of openings or apertures, for example as shown at 22, includes an edge 24, an edge 26 and an edge 28. The shelf sign system also includes a shelf 30 and a shelf 32. The shelves 20, 30, 32 are typically located in a retail store, such as a toy store, and permit the inexpensive display of a large number of retail items.

Additional shelves also run above and below the shelves 20, 30, 32. In FIG. 1, a lower shelf 34 with an edge 35 is shown beneath the shelf 20. Not shown in this figure are additional shelves that run beneath the shelf 30 and the shelf 32.

A sign unit 36 is connected to the shelves 20, 30, and 32 by a mounting bracket 38 and a mounting bracket 40. The sign unit 36 includes a sign surface 37, preferably made of clear or translucent plastic, and may house for example, an advertisement, a promotional poster, picture, product information, or the like. The mounting bracket 38 spans the shelves 20 and 30, drawing these shelves to a common plane. Similarly, the mounting bracket 40 spans the shelves 20 and 32, drawing these shelves to a common plane.

Figure 2:
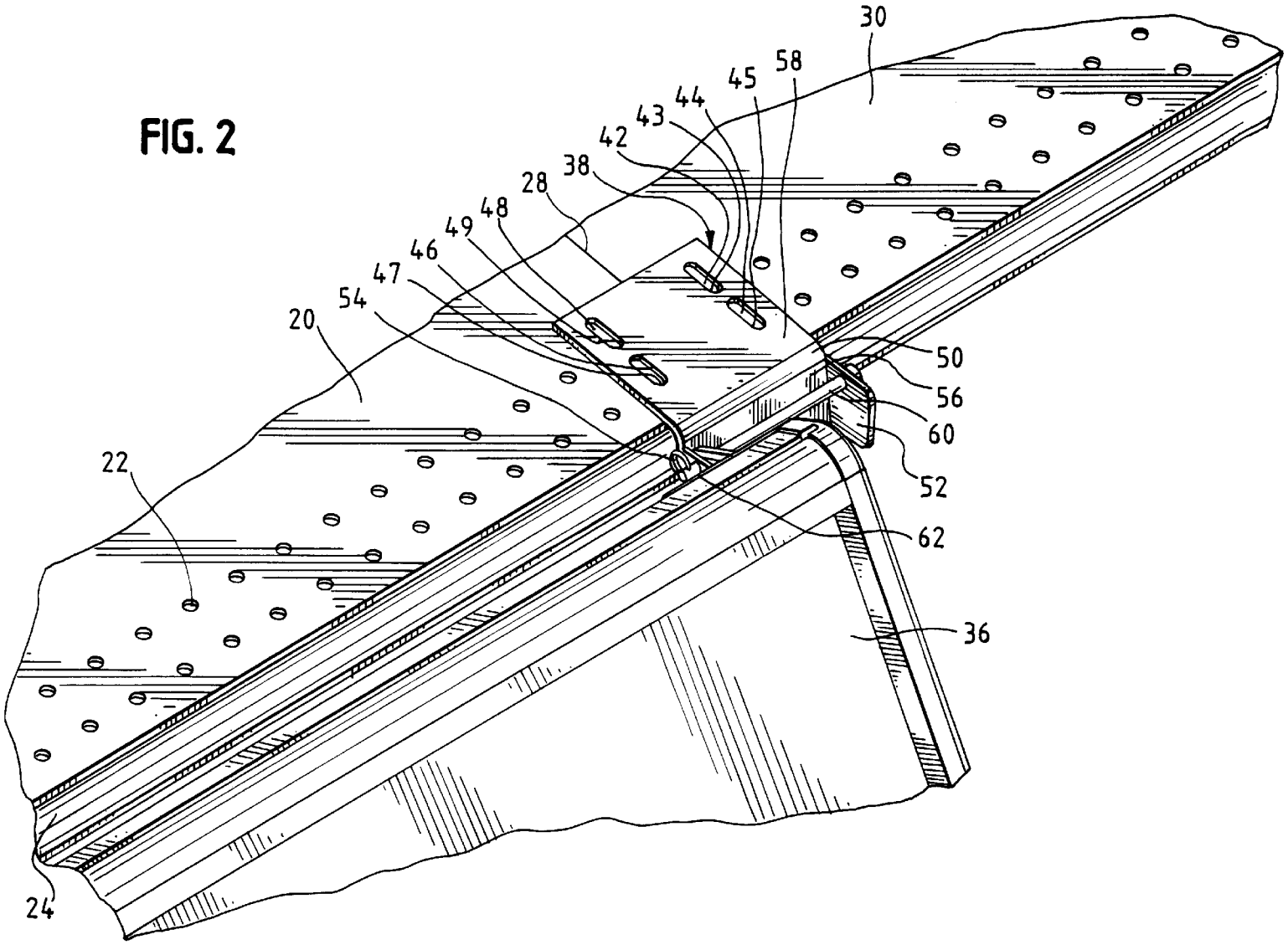
FIG. 2 is an enlarged oblique view of the shelf sign system invention of FIG. 1.

Further details of the mounting bracket 38 are shown in FIG. 2. The mounting bracket 38 includes four openings or apertures 42, 44, 46 and 48. The openings 42 and 44 in the mounting bracket 38 are above openings 43 and 45, respectively, in the shelf 30. Similarly, the openings 46 and 48 in the mounting bracket 38 are above openings 47 and 49 in the shelf 20. The mounting bracket 38 attaches to the shelves 20 and 30 by fastening devices, such as screws or bolts. For example, a screw (not shown) slides through the opening 42 and the opening 43, and a nut is attached on the underside of the shelf 30 to affix the mounting bracket 38 to the shelf 30. Similarly, fastening devices slide through the opening 44 and the opening 45, the opening 48 and the opening 49, the opening 46 and the opening 47, to affix the mounting bracket 38 to the shelf 30 and the shelf 20. The openings 42, 44, 46 and 48 are larger than the openings 43, 45, 47 and 49, respectively, allowing the mounting bracket 38 to slide along the shelves 20 and 30, thus permitting a greater tolerance for inconsistencies in the height and location of the shelves 20 and 30.

Figure 3:
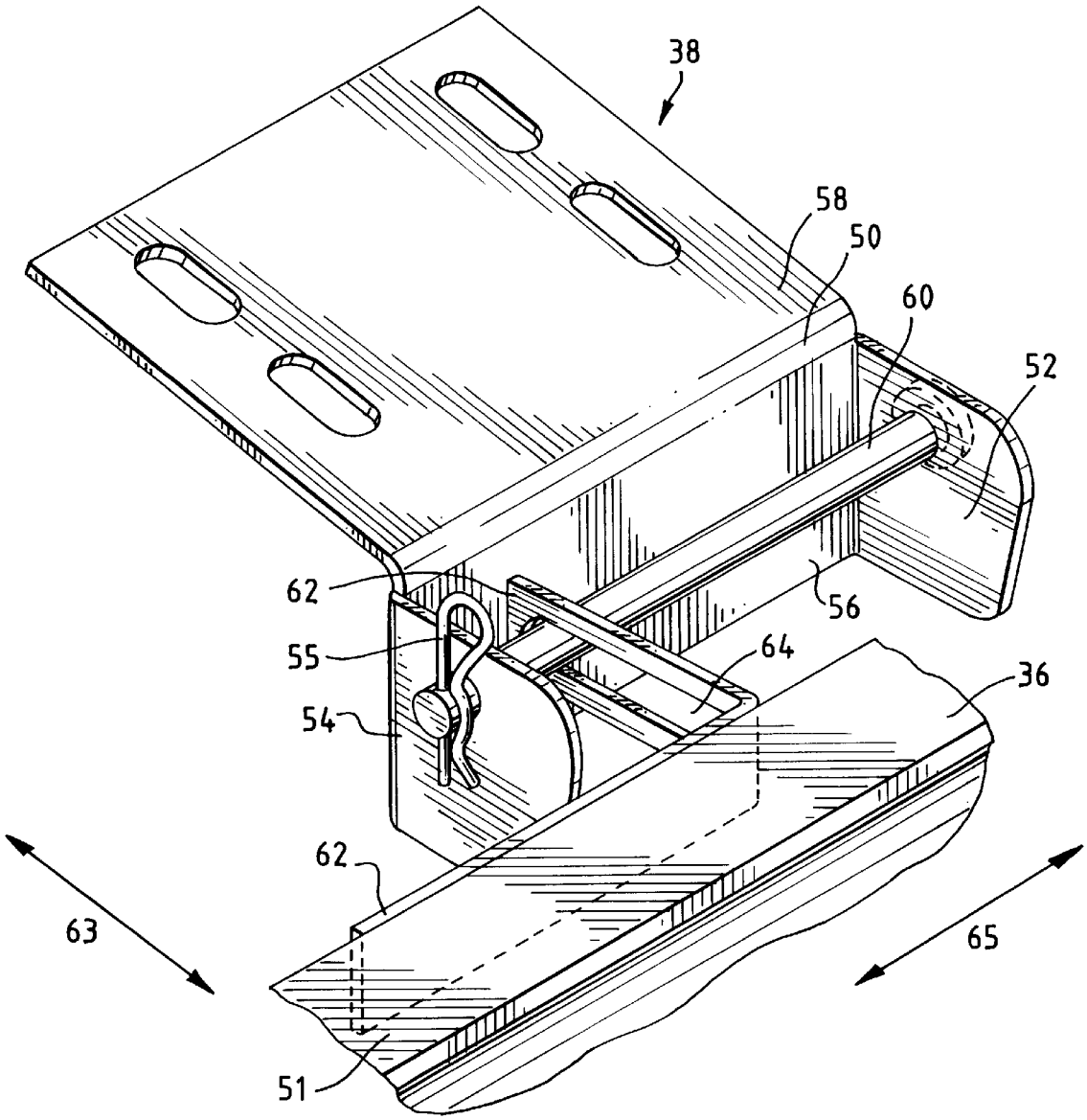
FIG. 3 is an enlarged oblique view of a pivot bracket used with the shelf sign system invention of FIG. 1 and FIG. 2.

As shown in FIG. 2 and FIG. 3, the mounting bracket 38 includes a curved portion 50 and two flanges 52 and 54 that extend from an edge face 56 of the mounting bracket 38. The mounting bracket 38 also includes a flat shelf portion 58 that rests on the shelves 20 and 30. Further, the mounting bracket 38 includes a cylindrical clevis pin 60. Preferably, the pin 60 rotates within circular openings in the flanges 52 and 54 and is held in the flanges 52 and 54 by a cotter pin 55. The pin 60 may be affixed to the flanges 52 and 54.

Further details of relationship between the mounting bracket 38 and the sign unit 36 are shown in FIG. 3. A pivot bracket 62 connects the sign unit 36 to the pin 60. The pivot bracket 62 is preferably L-shaped. Cut away lines at 51 show the pivot bracket 62 as it is affixed to the sign unit 36. The pivot bracket 62 includes an opening or aperture 64 that allows the bracket 62 and the sign unit 36 to slide toward and away from the pin 60 in the direction indicated by the arrow 63. In addition, the bracket 62 and the sign unit 36 slide laterally along the axis defined by the pin 60 in the direction indicated by the arrow 65. In addition, the pivot bracket 62 is rotatable about the pin 60.

Figure 4:
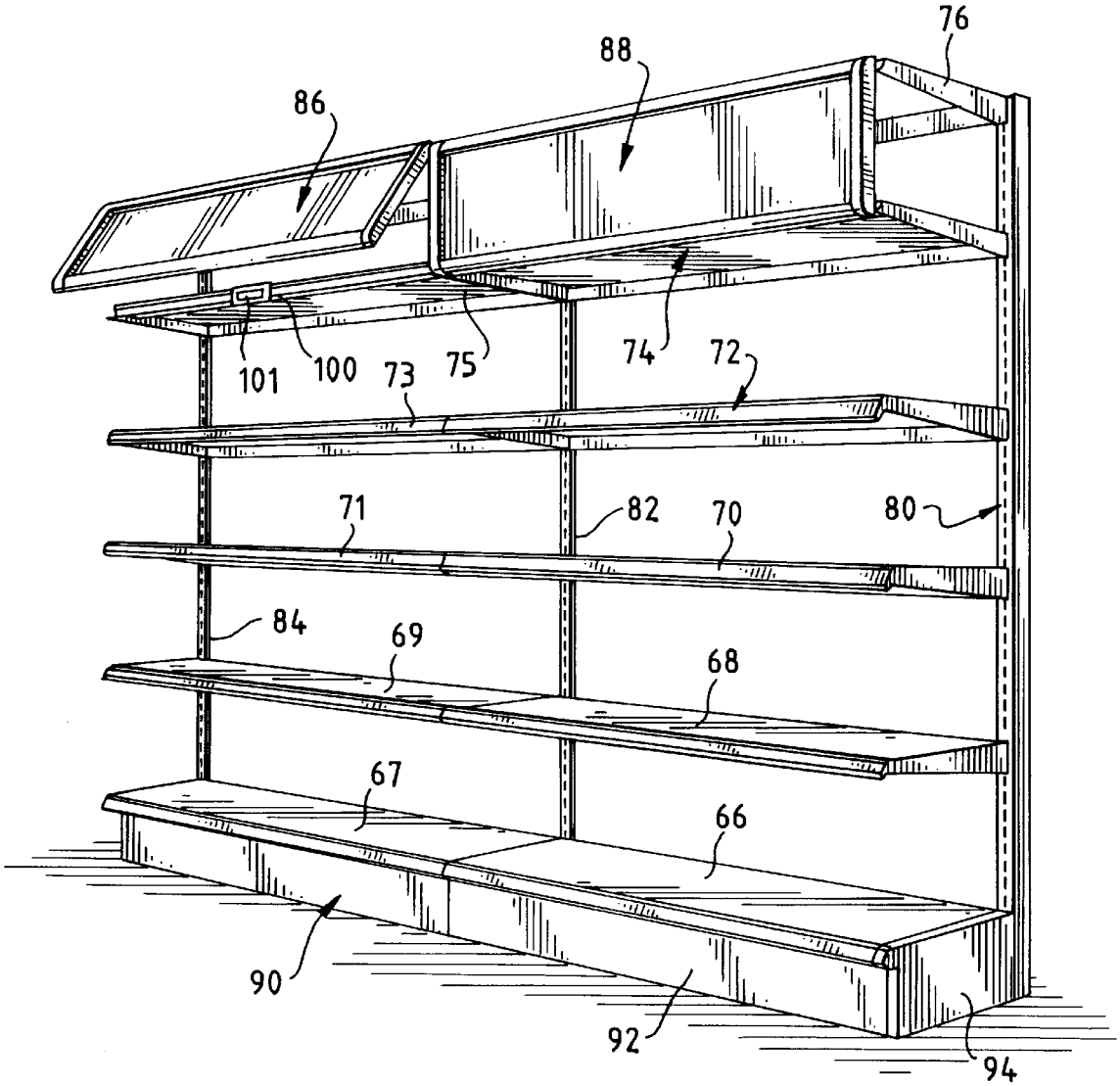
FIG. 4 is a front perspective view illustrating further details of a gondola frame system used with the present invention.

FIG. 4 illustrates further details of the gondola frame of the present invention with two sets of gondola shelves. Standard gondola shelves 66, 68, 70, 72, 74, and 76 are attached to slotted gondola uprights 80, 82. Similarly, standard gondola shelves 67, 69, 71, 73 and 75 are attached to slotted gondola uprights 82 and 84. A hook or slot as shown at 89 in FIG. 1 on the gondola shelf slides into an opening in the slotted gondola upright 82. Not shown in FIG. 4 is the standard gondola shelf positioned above the gondola shelf 75.

Referring still to FIG. 4, a sign unit 86, which is the same structure as sign unit 36, is shown in a partially "open" position. A sign unit 88, which is also the same as sign unit 36, is shown in a "closed" position. A stop bracket 100 prevents the open sign unit 86 from swinging into the shelf 75. The stop bracket 100 may preferably include a cushion, rubber extrusion or foam surface 101.

A gondola base plate 90 is positioned below the gondola shelf 67, and a gondola base plate 92 is similarly positioned below the gondola shelf 66. A base deck end cap 94 is positioned at the end of the gondola shelving unit shown in FIG. 4. A block out panel (not shown) may also be positioned at the end of the gondola shelves 74, 76 to cover the opening between the shelves 74, 76.

Figure 5:
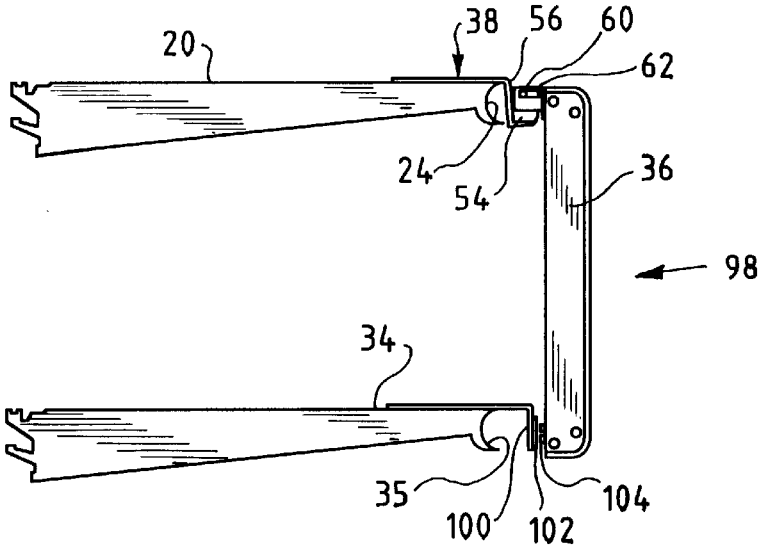
FIG. 5 is a side elevational view of the shelf sign system invention with the sign unit in the closed position.
Figure 6:
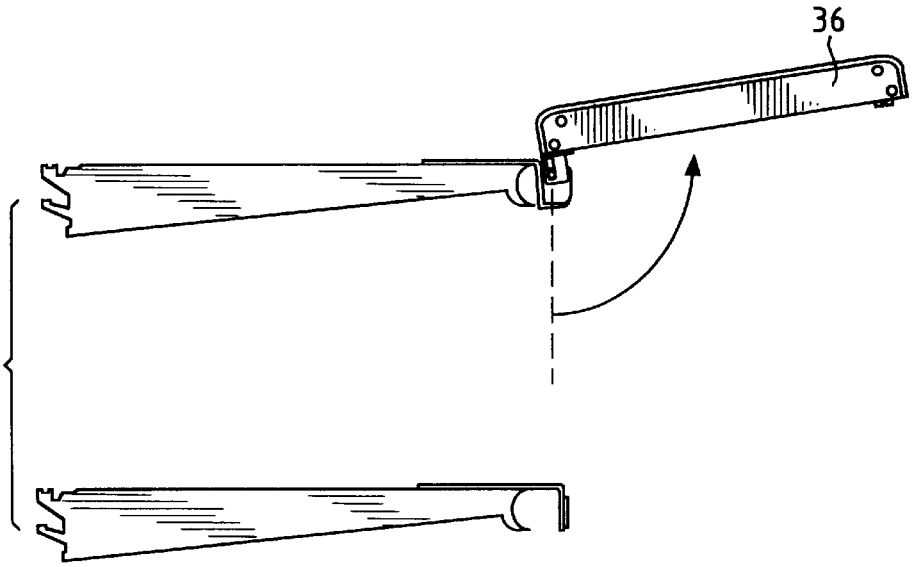
FIG. 6 is a side elevational view of the shelf sign system invention with the sign unit swung to the open position.
Figure 7:
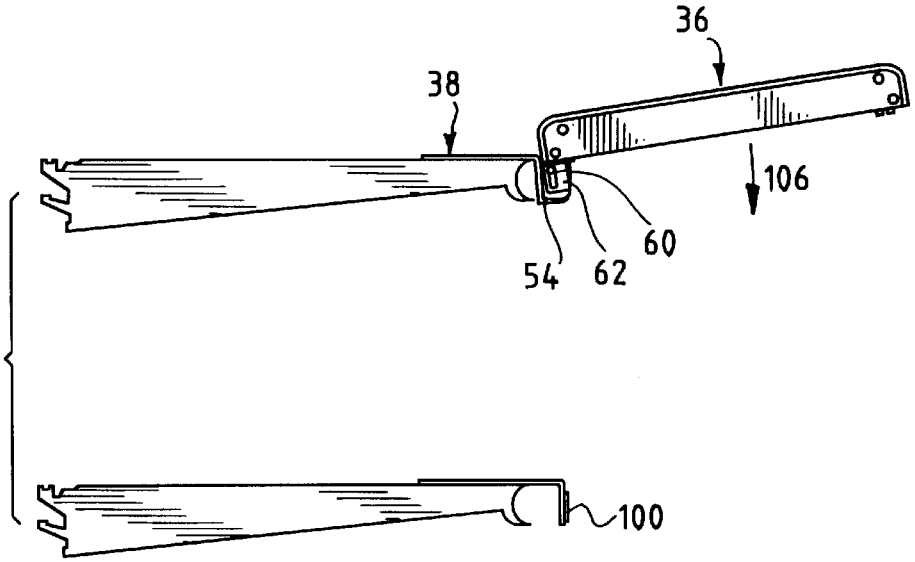
FIG. 7 is a side elevational view of the shelf sign system invention with the sign unit in the locked open position.

FIG. 5 is a side view of the present invention with the sign unit 36 in the "closed" position. A consumer approaches the sign shelf system in the direction indicated by the arrow 98 and views the message displayed on the sign unit 36. FIG. 6 shows the sign unit 36 in the "open" position, and FIG. 7 shows the sign unit 36 in the open and locked position. In FIGS. 5, 6, 7 and 7A, engagement of the pivot bracket 62 to the pin 60 is shown, although this view would be hidden by the flange 54.

The system includes the stop bracket 100, which prevents the sign unit 36 from swinging past a plane defined by the edge face 56 of the mounting bracket 38 and the stop bracket 100. The stop bracket 100 includes a bumper 102. A channel 104 runs the length of the sign unit 36.

Referring to FIG. 5, the sign unit 36 may be fastened along the channel 104 to the stop bracket 100. This embodiment is useful where easy opening of the sign unit 36 is not desirable, for example, where a lighting assembly is housed behind the sign unit 36 on the shelf 34.

Figure 7A:
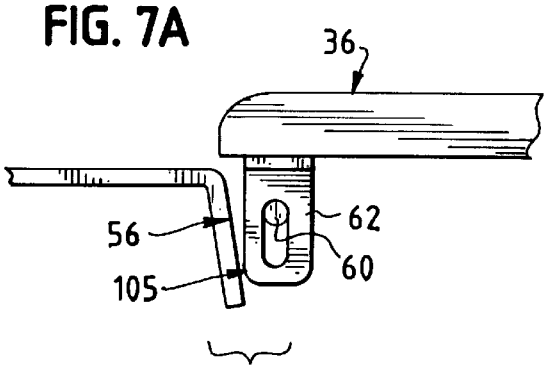
FIG. 7A is a side elevational view showing further details of the shelf sign system of FIG. 7.

As noted, FIGS. 7 and 7A show the sign unit in the open and locked position. After the sign unit 36 swings to the up position, as in FIG. 6, the pivot bracket 62 then slides along the pin 60 in the direction of the arrow 106 in FIG. 7. As shown in FIG. 7A, in which the flange 54 is hidden, a corner 105 of the pivot bracket 62 thus rests against the edge surface 56 of the mounting bracket 38 and the pin 60, and the sign unit 36 remains in the open locked position.

Figure 8:
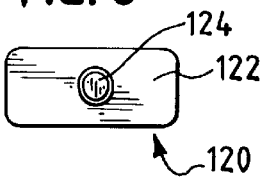
FIG. 8 is a front elevational view of a fastener employed in the invention.
Figure 9:
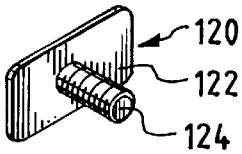
FIG. 9 is side oblique view of the fastener of FIG. 8.
Figure 10:
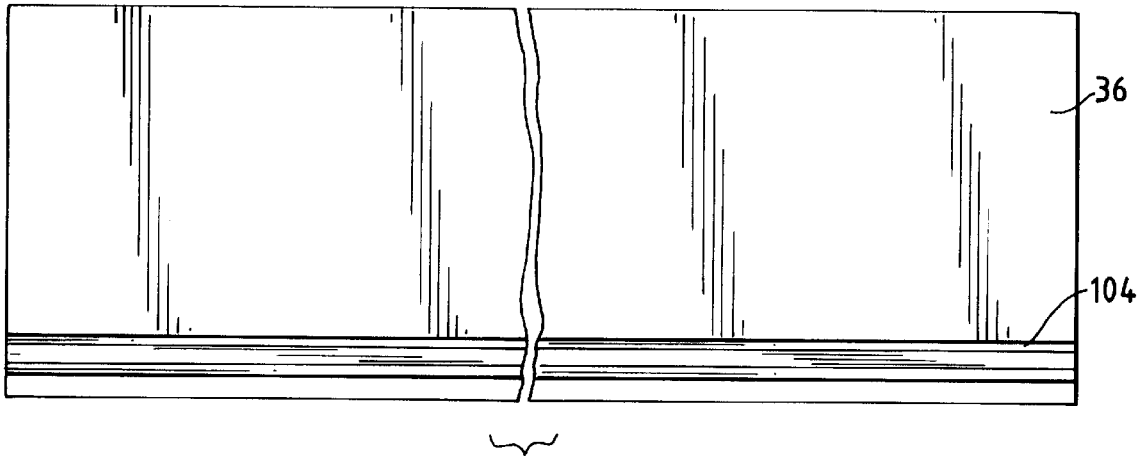
FIG. 10 is a rear elevational view of the sign unit.
Figure 11:
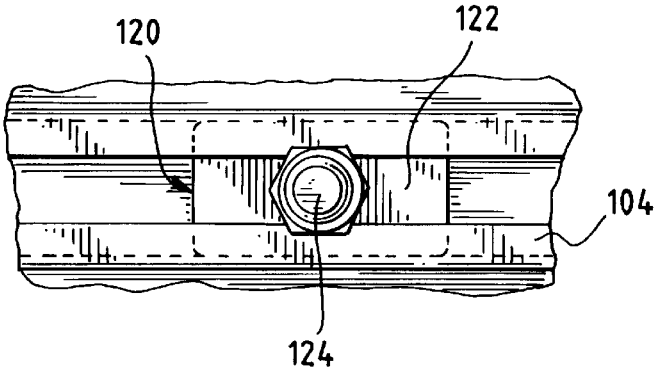
FIG. 11 is an enlarged back elevational cut away view of the fastener in a channel of the sign unit.

FIG. 8 and FIG. 9 are two views of a frame fastener 120 that slides along the channel 104 shown in FIG. 10. The fastener 120 includes a flat portion 122 and an extending screw 124. FIG. 11 shows the fastener 120 as it is slidably engaged in the channel 104.

Figure 12:
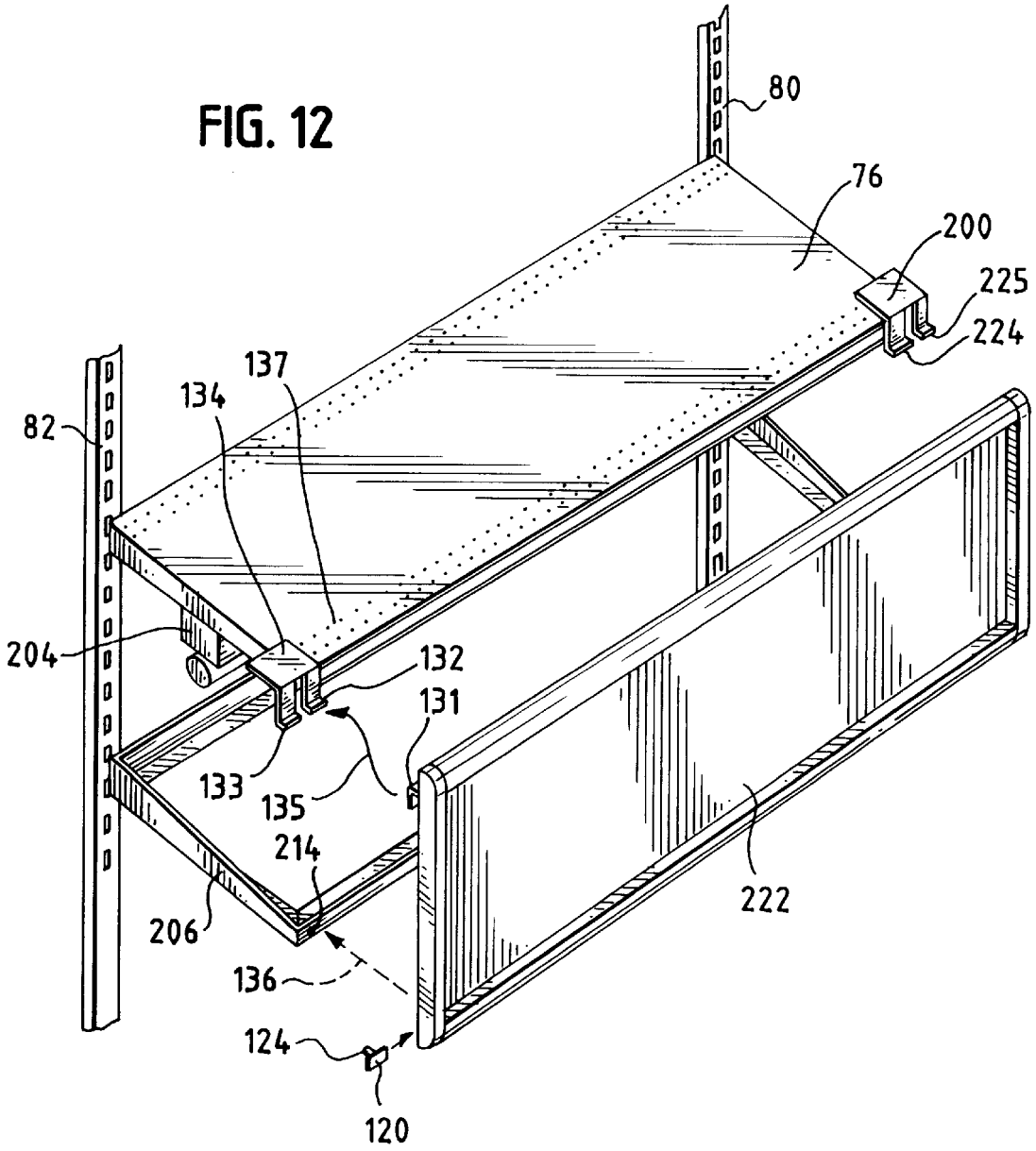
FIG. 12 is an overhead oblique view of an alternative embodiment of the present invention.

FIG. 12 depicts an alternative preferred embodiment of the present invention. In this embodiment, the sign unit is not rotatable. A sign unit 222 is shown prior to installation, which is accomplished by inserting a bracket or locking tab 131 into an opening or slot 132 in a bracket 134, which also includes a slot 133 for receiving a tab or slot from a neighboring sign (not shown). The sign unit 222 is affixed to the bracket 134 in the direction indicated by the arrow 135. In addition, a fastener 120 extends through an aperture or opening 214 in a diffuser frame 206, as indicated by arrow 136. As indicated in FIG. 10 and FIG. 11, the diffuser fastener 120 slides along a channel 104 in the sign unit, thus permitting tolerance variances in the horizontal position of slots in the diffuser frame 206 relative to the sign unit 222. As indicated in FIG. 12, the vertical slots such as slot 214 allow for vertical height variances in the vertical location of the diffuser fastener 120.

Similarly a second bracket or tab (not shown) in the sign unit 222 is inserted in an opening or slot 224 in a bracket 200. The bracket 200 also includes a second opening or slot 225 for receiving a tab from a neighboring sign unit (not shown).

The brackets 134 and 200 are attached to the gondola shelf 76 by known methods, such as a screw and nut pair inserted through openings in the brackets 134, 200 and the gondola shelf 76, for example as shown at 137. The diffuser frame 206 is coupled to the gondola uprights 80, 82 in the same manner that the gondola shelf 76 is coupled to the gondola uprights 80, 82. Once installed, a light fixture 204 illuminates the sign unit 222. Thus, an advertisement in the sign unit 222 is illuminated, enhancing consumer interest in the advertisement.

Figure 13:
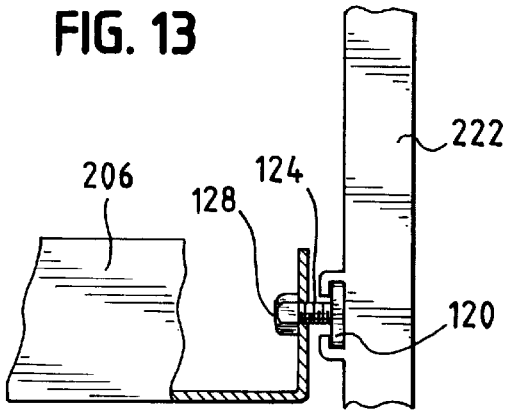
FIG. 13 is a side elevational view of the fastener configuration of FIG. 1.

FIG. 13 is a side elevational view of the sign system invention similar to the perspective of FIGS. 5, 6 and 7. The fastener 120 is slidably engaged in a channel in the sign unit 222. The fastener 120 extends through an opening in the diffuser frame 206 and a nut 128 is attached to the end of a fastener 120. The diffuser frame 206 in FIG. 13 is shown in a cut-away view, as indicated by the jagged lines. In an alternative embodiment, the fastener arrangement of FIG. 13 is employed with the rotatable sign of FIGS. 1 and 2.

Figure 14:
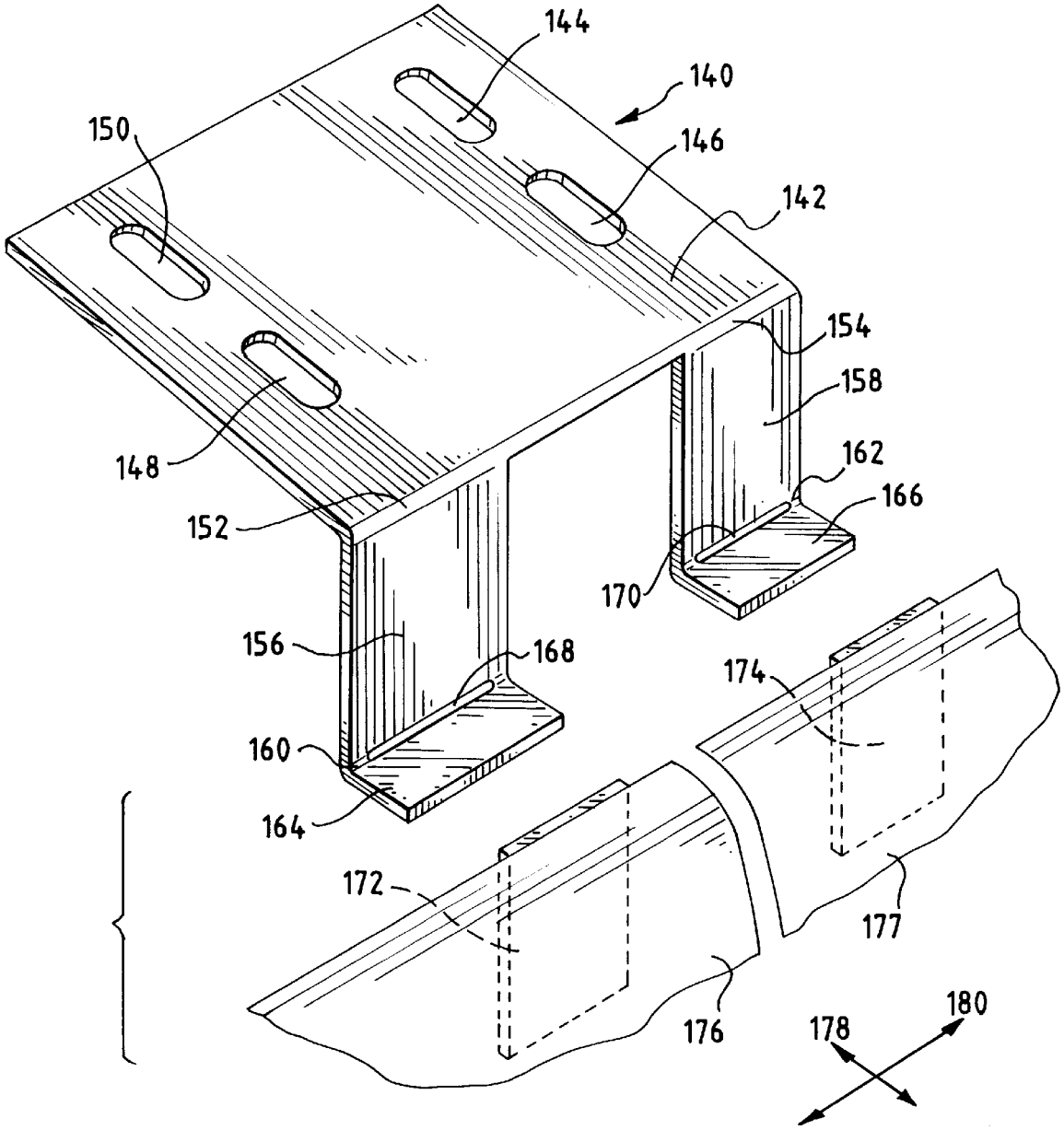
FIG. 14 is an overhead oblique view of a mounting bracket of the type used in FIG. 12.

FIG. 14 illustrates further details of a mounting bracket 140 used with the present invention. The mounting bracket 140 includes a shelf portion 142 and openings 144, 146, 148 and 150. The mounting bracket 140 further includes curved portion 152, 154, tongue portions 156 and 158, curved portions 160, 162 and flat portions 164, 166. Openings 168 and 170 in the curved portions 160, 162, respectively, slidably engage locking tabs 172, 174 on the back of a first sign unit 176 and a second sign unit 177, respectively. In this embodiment, the sign units 176 and 177 are not rotatable, although, depending on the size of locking tabs 172 and 174 with respect to the openings 168 and 170, the sign units 176, 177 may be slidable in the directions indicated by the arrows 178 and 180.

Figure 15:
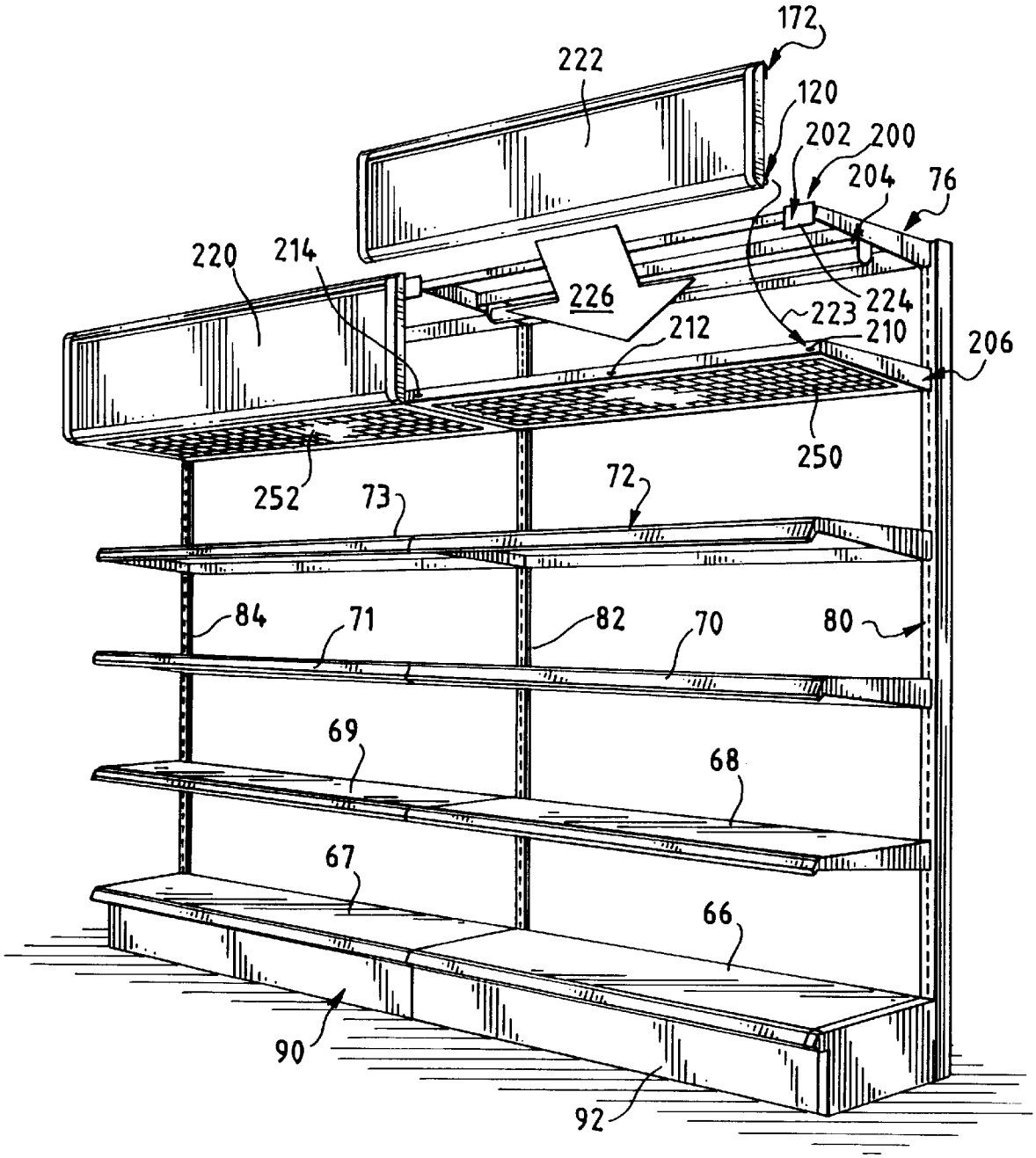
FIG. 15 is a front perspective view illustrating further details of the gondola frame system used with a mounting bracket of the type in FIG. 14.

FIG. 15 illustrates further details of the system employing the mounting bracket of FIG. 13. As in FIG. 4, standard gondola shelves 67, 69, 71 and 73 are affixed to slotted gondola uprights 82, 84. In addition, standard gondola shelves 66, 68, 70, 72 and 76 are affixed to the gondola uprights 80, 82.

A mounting bracket 200 is affixed to the standard gondola shelf 76. A fluorescent fixture 204 is mounted to the underside of the shelf 76. A steel diffuser frame 206 is coupled to the slotted gondola uprights 80, 82.

FIG. 15 depicts two sign units. Sign unit 220 is installed, while sign unit 222 is shown prior to installation, which is accomplished by inserting a tab 172 into a slot 224 in the bracket 200 in the direction indicated by the arrow 226. In addition, the fastener 120 extends through the opening 210 in the diffuser frame 206, as shown by the arrow 223. Similarly, openings or slots 212, 214 can receive other fasteners. As indicated in FIG. 10 and FIG. 11, the fastener 120 slides along a channel 104 in the sign unit, thus permitting tolerance variances in the height of the diffuser frame 206 relative to the sign unit 222.

Once installed, the light fixture 204 illuminates the sign unit 222. Thus, an advertisement in the sign unit 222 is illuminated, enhancing consumer interest in the advertisement. In addition, light from the light fixture 204 shines through light diffuser 250 to shelf 72, thus illuminating merchandise on the shelf 72. Similarly, a light diffuser 252 is situated over the shelf 73.

Figure 16:
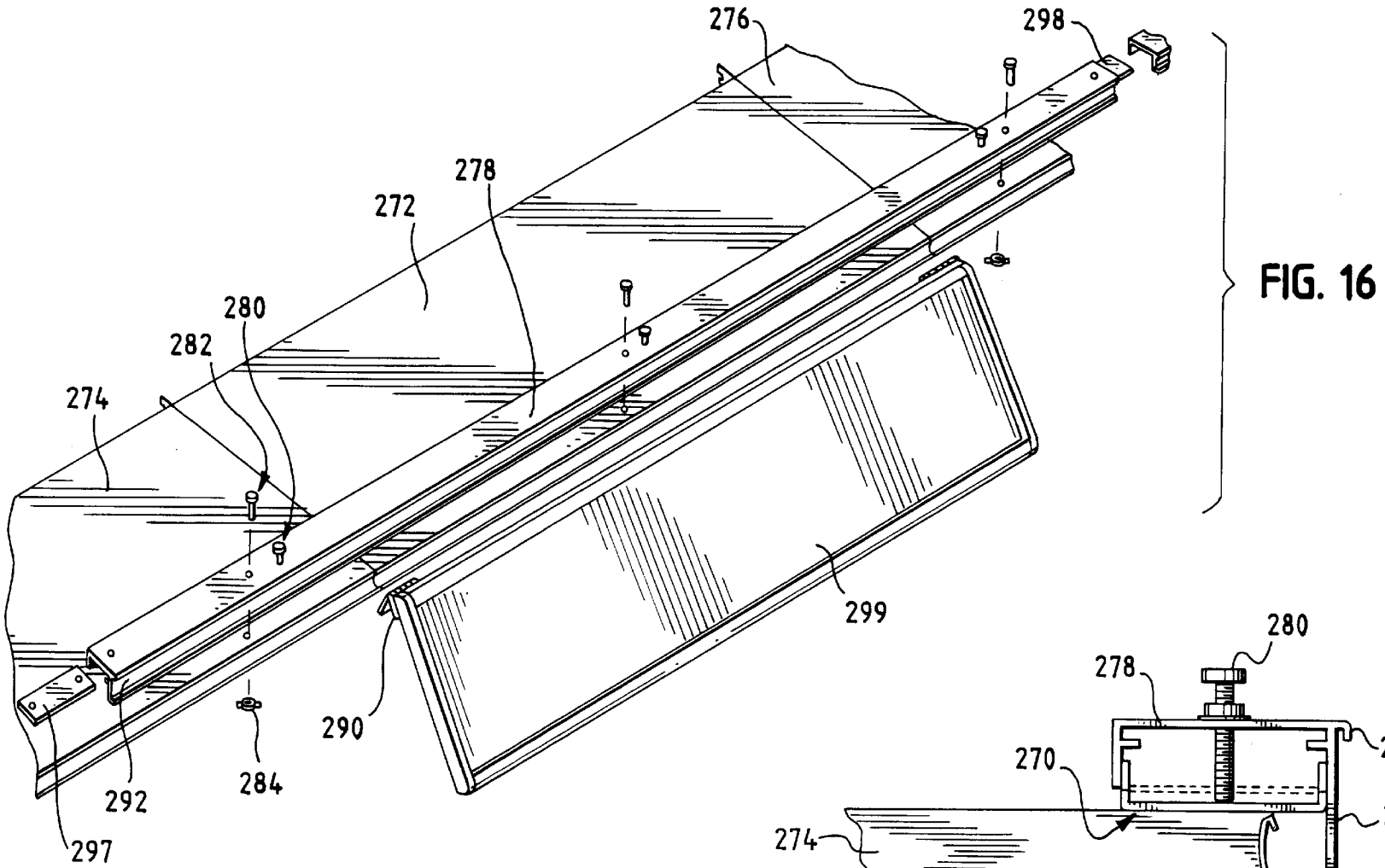
FIG. 16 a front overhead exploded oblique view of an alternative embodiment of the present invention.
Figure 17:
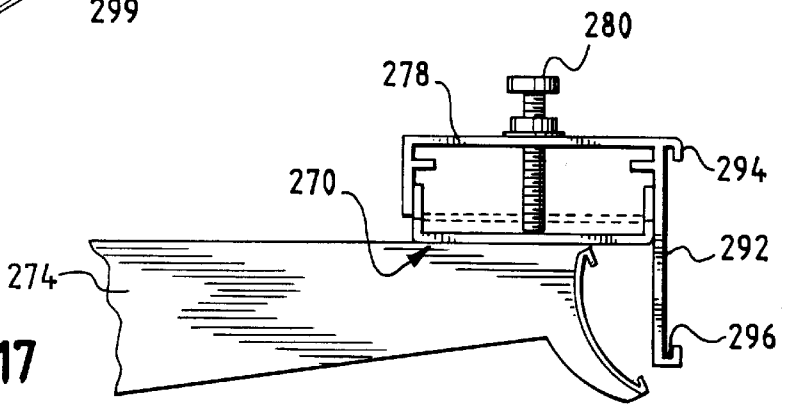
FIG. 17 is a side elevational view further illustrating the embodiment of FIG. 16.

An alternative embodiment of the present invention is illustrated in FIGS. 16 and 17. A covering channel 278, which may be six to ten feet long, spans shelves 272, 274, 276. A leveling plate 270, which is about 2 inches long, rests against the covering channel 278. Multiple leveling plates (not shown) are spaced along the covering channel 278. A leveling bolt 280 is attached to the leveling plate 270 and is threaded through the covering channel 278. Similar to the manner in which the vertical height of some office furniture is adjustable, and as one skilled in the art would understand, turning the leveling bolt 280 causes the covering channel 278 to raise or lower in relationship to the plane defined by the surface of the shelf 272. When the appropriate level is achieved along all covering plates in the installation, a locking bolt 282 is fastened through the covering channel 278 to a wingnut 284, securing the level of the covering plate and the shelves 272, 274 and 276. Connector plates 297, 298 attach one covering channel to another. A hinge assembly 290 slides into a channel 292 and engages grooves 294, 296 to join a sign unit 299 to the covering plate 278.

Figure 18:
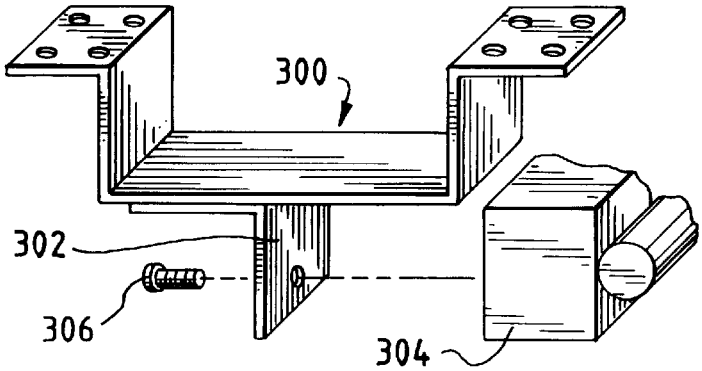
FIG. 18 is a side oblique view of an apparatus for mounting a light fixture to a gondola shelf.
Figure 19:
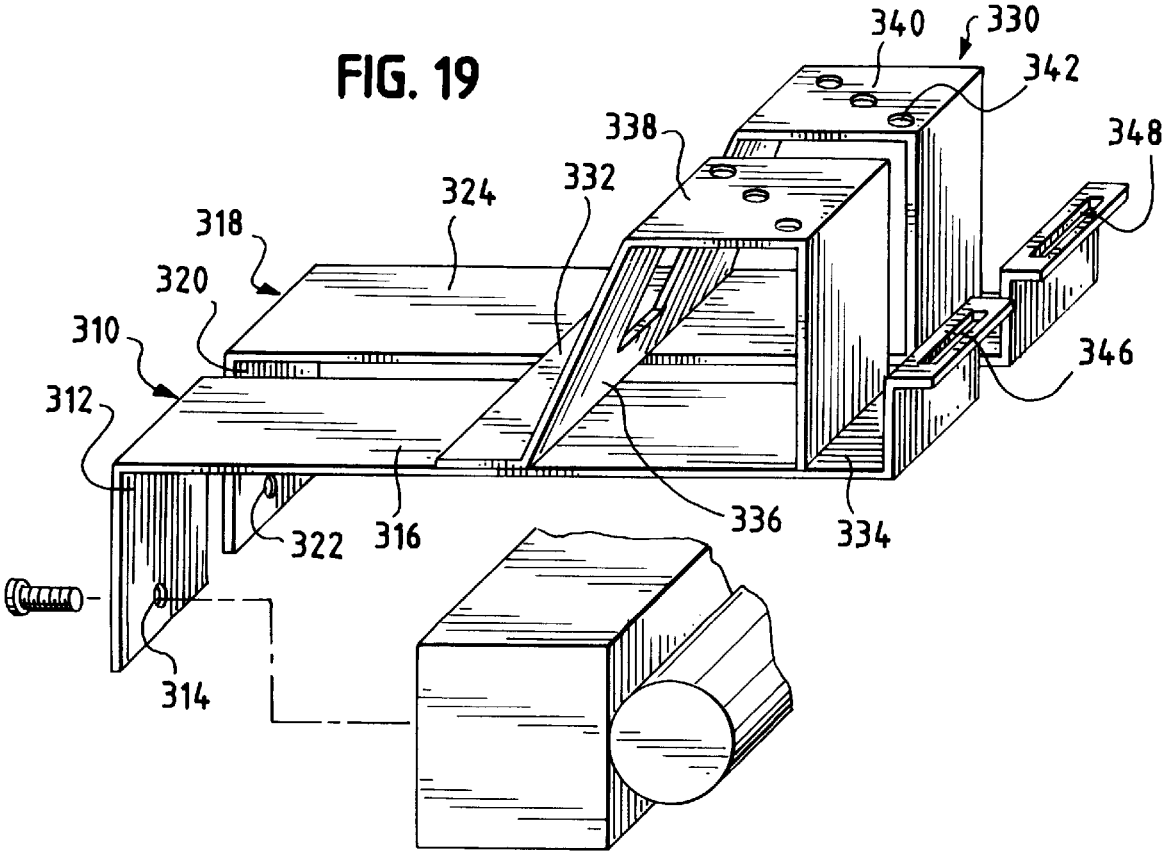
FIG. 19 is a side oblique view of an alternative apparatus for mounting a light fixture and sign unit to a gondola shelf.

FIGS. 18 and 19 illustrate further details regarding attaching a light fixture to the shelving system. Referring to FIG. 18, a light bracket 300 attaches to the underside of a gondola shelf, for example shelf 76 in FIG. 12, via screws or bolts through openings in the light bracket 300 and the shelf 76. An L-shaped apparatus 302 attaches to the bracket 300, and a light fixture 304 is affixed to the apparatus 302 via a screw or bolt 306.

FIG. 19 depicts an alternative embodiment of a shelf mounting bracket combined with a light fixture mounting bracket. An L-shaped metal strip 310 includes a first face 312 with an opening 314 and a second face 316. Similarly, an L-shaped metal strip 318 includes a first face 320 with an opening 322 and a second face 324. Welded to the metal strips 310 and 318 is a mounting apparatus 330. The mounting apparatus 330 includes flat portions 332 and 334 where the mounting apparatus 330 is affixed to the metal strips 310, 318. A U-shaped slanted face 336 extends from the flat portion 332 to shelf mounting faces 338, 340. Openings, for example at 342, are aligned with openings, for example at 137 in shelf 76 in FIG. 12. A screw or fastening device (not shown) is inserted through the opening at 340 to attach the mounting apparatus 330 to the shelf The flat portion 334 is situated under the edge of the shelf, and the sign unit (not shown) is inserted into one of the slots 346, 348 as described previously in this specification.

It is to be understood that alternative forms of the various components of the described embodiments are covered by the full scope of equivalents of the claimed invention. To particularly point out and distinctly claim the subjects regarded as the invention, the following claims conclude this specification.

What is claimed is:

1. A gondola shelf sign system comprising:

a first gondola shelf and a second gondola shelf each having a front edge;

a mounting bracket attached to the first gondola shelf substantially at the front edge of the first gondola shelf and attached to the second gondola shelf substantially at the front edge of the second gondola shelf, the mounting bracket spanning the first gondola shelf and the second gondola shelf; and a rotatable sign unit engaged with the mounting bracket and being rotatable about the mounting bracket.

2. A shelf sign system as in claim 1 wherein the sign unit is slidably engaged with the mounting bracket permitting lateral movement of the sign unit.

3. A shelf sign system as in claim 1 wherein the mounting bracket includes a first flange with a first flange opening and a second flange with a second flange opening and a pin rotatably disposed in the first flange opening and the second flange opening, wherein the sign unit is engaged with the pin.

4. A shelf sign system as in claim 3 wherein the sign unit includes an L-shaped pivot bracket slidably engaging the pin.

5. A shelf sign system as in claim 3 wherein the sign unit is rotatable from a first closed to a second open position.

6. A sign system as in claim 5 further comprising: a pivot bracket attached to the sign unit and having an aperature that allows the sign unit to rotate about the pin and that allows the sign unit to slide toward and away from the pin such that the pivot bracket can engage an edge face of the mounting bracket and an inner surface of the aperature can engage the pin to support the sign unit in a locked open position.

7. A shelf system as in claim 1 further comprising:

a first affixing device attaching the mounting bracket to the first shelf, the first affixing device engaged in a first shelf opening and a first mounting bracket opening; and a second affixing device attaching the mounting bracket to the second shelf, the second affixing device engaged in a second shelf opening and a second mounting bracket opening.

8. A sign system comprising:

a first shelf defining a first plane;

a second shelf defining a second plane;

a mounting bracket, the mounting bracket affixed to the first shelf substantially at a front edge of the first shelf, affixed to the second shelf substantially at a front edge of the second shelf, and substantially equaling the first plane and the second plane; and a sign unit engaged in the mounting bracket.

9. A sign system as in claim 8 wherein the sign unit is rotatably engaged and laterally slidable in the mounting bracket.

10. A sign system as in claim 8 wherein the sign unit includes a pivot bracket engaged with a pin in the mounting bracket, the pin defining an axis about which the sign unit is rotatable.

11. A sign system as in claim 10 wherein the pivot bracket includes an aperture slidably engaging the pin, the pivot bracket laterally slidable along the pin.

12. A sign system as in claim 11 wherein the aperture is larger than the diameter of the pin and the sign unit is slidable toward and away from the pin.

13. A sign system as in claim 12 wherein the sign unit is rotatable to a first closed and a second open position.

14. A sign system as in claim 13 wherein the mounting bracket includes a first flange and a second flange housing the pin, the aperature of the pivot bracket allows the sign unit to vertically slide along the pin when the sign unit is in the open position so that the pivot bracket rests against an edge face of the mounting bracket and an inner surface of the aperature rests against the pin.

15. A sign system as in claim 10 further comprising a stop bracket coupled to a lower shelf disposed beneath the first shelf, the stop bracket limiting the rotation of the sign unit.

16. A sign system as in claim 8 wherein a fastener is slidably engaged in a channel in the sign unit, the fastener attaching to a stop bracket.

17. A sign system as in claim 8 further comprising:

a diffuser sign frame disposed beneath the first shelf;

a fastener slidably engaged in a channel in the sign unit, the fastener attaching to the diffuser frame.

18. A gondola shelf sign system comprising:

a center gondola shelf including a center shelf opening, the center shelf opening being adapted to receive a fastener;

a side gondola shelf including a side shelf opening, the side shelf opening being adapted to receive a fastener;

a mounting bracket having first and second mounting bracket opening adapted to receive a fastener, the mounting bracket spanning the center gondola shelf and the side gondola shelf, a first fastener inserted in the first mounting bracket opening and the center shelf opening;

a second fastener inserted in the second mounting bracket opening and the side shelf opening; and a sign unit affixed to the mounting bracket.

19. The shelf sign system of claim 18 wherein the mounting bracket comprises:

a shelf surface with a first and a second mounting bracket opening, the shelf surface resting against the center gondola shelf and the side gondola shelf;

a curved portion resting against the center gondola shelf and the side gondola shelf;

a first flange extending from the curved portion;

a second flange extending from the curved portion;

a pin coupled to the first flange and the second flange, wherein said sign unit is rotatably engaged with the pin.

20. The shelf sign system of claim 19 further comprising a pivot bracket coupled to the sign unit, wherein the pivot bracket slidably engages the sign unit to the pin.

* * * * *